US005456399A

United States Patent [19]

Yamaguchi

[11] Patent Number: 5,456,399

[45] Date of Patent: Oct. 10, 1995

[54] TRACTOR MECHANISM COMPENSATING FOR PAPER TAPER

[75] Inventor: Naoto Yamaguchi, Suwa, Japan

[73] Assignee: Seiko Epson Corporation, Tokyo, Japan

[21] Appl. No.: 197,902

[22] Filed: Feb. 17, 1994

[30] Foreign Application Priority Data

Feb. 17, 1993 [JP] Japan ..... 5-028194
Oct. 29, 1993 [JP] Japan ..... 5-294103

[51] Int. Cl.[6] ..... B65H 20/20; B41J 11/32

[52] U.S. Cl. ..... 226/75; 400/616.1

[58] Field of Search ..... 226/74, 75, 79, 226/76; 400/616.1

[56] References Cited

U.S. PATENT DOCUMENTS 4,469,263 9/1984 Seitz ..... 226/74
4,475,677 10/1984 Rutishauser ..... 226/74

FOREIGN PATENT DOCUMENTS 1-271344 10/1989 Japan .

*Primary Examiner*—Daniel P. Stodola
*Assistant Examiner*—Thomas E. Dun
*Attorney, Agent, or Firm*—Stroock & Stroock & Lavan

[57] ABSTRACT

A tractor and a continuous paper feed mechanism using the same which can more accurately convey continuous paper in a forward or reverse paper conveying direction by compensating for an increase or decrease in the width (taper) of the continuous paper due to a change in temperature or humidity. The change in paper width is compensated for by either employing a tractor having a pin belt that can incline relative to the paper conveying direction or by employing a tractor that pivots in accordance with the change in paper width to incline the pin belt.

19 Claims, 8 Drawing Sheets

TRACTOR MECHANISM COMPENSATING FOR PAPER TAPER

BACKGROUND OF THE INVENTION

The present invention relates generally to a tractor for use in delivering continuous paper in a printing device, such as a printer or the like, and also to a continuous paper feed mechanism using such a tractor. In particular, the present invention relates to a tractor capable of conveying, both in the forward and in the reverse direction, continuous paper when the width thereof varies due to a change in temperature or humidity. The present invention also relates to a continuous paper feed mechanism using such a tractor.

Generally, a tractor which includes an endless pin belt with arrays of pins thereon is constructed and arranged so that holes formed on the two sides of the continuous paper engage the pins of the pin belt to feed the continuous paper. If the width of the continuous paper increases or decreases due to a change in temperature or humidity when the position of the tractor (that is, the pin belt) is fixed, the holes of the continuous paper cannot properly engage the pins of the tractor, resulting in an inability to properly feed the continuous paper.

Japanese Patent Laid-Open Publication No. 1-271344 (Heisei) describes a proposed tractor that attempts to solve the heretofore mentioned problem. FIG. 9 depicts a plan view of the tractor described in Japanese Patent Laid-Open Publication No. 1-271344 (Heisei).

Shown in FIG. 9 is a drive shaft 1, a guide shaft 2 and a frame member 3 which is slidably mounted onto drive shaft 1 and guide shaft 2. A tractor 4 is positioned within frame member 3 and is slidably mounted onto drive shaft 1 and guide shaft 2. Tractor 4 is forced in the direction of arrow X1, as shown in FIG. 9, by a spring 5 interposed between frame member 3 and tractor 4. Holes 6*a* are respectively formed on the two side portions of continuous paper 6. Tractor 4 also includes a pin belt, with a plurality of pins 4*a* disposed thereon. Pins 4*a* are aligned and meshed with holes 6*a* to convey continuous paper 6 in a sheet feeding direction. A cover plate 4*b* is provided for guiding continuous paper 6 and loosely holding the side portion 6*b* of continuous paper 6 between the pin belt and cover plate 4*b*. Cover plate 4*b* has an elongated hole 4*c* formed therein that allows pins 4*a* to extend therethrough. A lock mechanism 7 selectively secures frame member 3 to guide shaft 2, so that frame member 3 can be prevented from sliding.

Although FIG. 9 depicts only the left tractor, the right tractor is identical to the tractor of FIG. 9 except to the extent that the right tractor does not include frame member 3 and spring 5. The right tractor is also fixed to guide shaft 2.

In this arrangement, spring 5 constantly applies tension to continuous paper 6, causing tautness in continuous paper 6 in the widthwise direction. Therefore, even if the width W of continuous paper 6 increases or decreases due to a change in temperature or humidity, the increase or decrease is compensated by the sliding of tractor 4 along drive shaft 1 and guide shaft 2 and the two side edge portions 6*b* of continuous paper 6 are kept parallel to each other. In this manner, continuous paper 6 can be conveyed in the forward or reverse direction.

The conventional tractor employing the structure described above has the following problem. When the width W of the continuous paper increases or decreases while the two sides edge portions 6*b* of continuous paper 6 remain parallel to each other, the paper increase or decrease in the widthwise direction is compensated by sliding tractor 4 horizontally so that continuous paper 6 can be properly conveyed. However, in some instances, the width of the continuous paper does not uniformly increase or decrease in such a manner that the two side edge portions 6*b* remain parallel, but rather, the side edge portions 6*b* vary in such a way that the continuous paper, when viewed lengthwise, appears to taper.

Although the conventional tractor will slide, the tractor cannot accurately follow the variations in the paper when the two side edge portions of the continuous paper taper. As a result, holes 6*a* of continuous paper 6 may shift, causing a misalignment between at least one pin 4*a* and at least one hole 6*a*, resulting in unreliable paper conveying, regardless of whether it is in a forward or reverse direction.

The variation in width of the continuous paper may be caused by a change in the temperature or humidity. Most frequently, the change will occur because of the frequent changes in temperature or humidity during the course of an average day, week, etc. where the printer is operating. A change may also occur when the continuous paper supply is transported from one environment with a set temperature and/or humidity to another environment having a different temperature and/or humidity. As will be explained below, because different portions of the paper are exposed to different amounts of the outside air, the paper, throughout a predetermined length, may vary in width by a relatively large amount.

Reference is now made to FIGS. 10(*a*), (*b*) and FIG. 11 to more specifically illustrate the effect of having different portions of the continuous paper exposed to different temperature and/or humidity conditions.

As illustrated in FIG. 10(*a*), alignment is typically made between a front end 6*c* of continuous paper 6 and the conventional tractor of a conventional printing apparatus 8, while the remaining continuous paper portion 6*d* of continuous paper 6 remains in a corrugated cardboard box 9, placed by way of example, on the floor.

By way of example, an air conditioning unit may reduce the humidity within the room that houses printing apparatus 8. The portion of continuous paper 6 between printing apparatus 8 and corrugated cardboard box 9 which is exposed to the air has water being constantly evaporated therefrom, causing continuous paper 6 to decrease in the widthwise direction. However, the unused portion 6*d* of continuous paper 6, which remains in corrugated cardboard box 9, is essentially not exposed to the air, but for the end portion thereof. Accordingly, unused portion 6*d* will have more moisture therein than the exposed portion of continuous paper 6 and therefore may also be wider than the exposed portions of the continuous paper.

In other words, the width of continuous paper 6 proximate to printing apparatus 8 maybe narrower than the width of continuous paper 6 within corrugated cardboard box 9. Accordingly, as shown in FIG. 1t, the width of continuous paper 6 may vary in a tapered manner from a wide portion to a narrow portion.

As noted above, variations in the nature of the taper in the width of continuous paper can result when temperature and/or humidity varies between the place storing the continuous paper and the location of the continuous paper where the printing apparatus is ultimately located. Thus, for example, if continuous paper 6 is stored in an area having an essentially constant high temperature or humidity, in a warehouse for example, then continuous paper 6 will absorb a relatively large amount of water and the width of continuous paper 6 will increase. However, if the expanded continuous paper 6 is then used with printing apparatus 8 in an environment where the temperature and/or humidity is low, such as in an air conditioned facility, the portion of continuous paper 6 proximate to printing apparatus 8 will essentially immediately begin drying because of the evaporation of moisture. Accordingly, the width of continuous paper 6 will decrease. However, unused portion 6*d* of continuous paper 6 located within corrugated cardboard box 9 will not have moisture evaporate therefrom at the same rate as the portion proximate to printing apparatus 8 because only the end portion thereof is exposed to the air. Therefore, the width of the paper in corrugated box 9 will not decrease as rapidly or as much as the portion proximate to printing apparatus 8, and the width of continuous paper 6 proximate to printing apparatus 8 will not equal the paper width of continuous paper 6 within corrugated cardboard box 9. Again, FIG. 11 illustrates a sheet of continuous paper that varies in width. The paper width tapers from the wide portion to the narrow portion and, hence, does not feed properly.

When the width of continuous paper 6 varies in the tapered manner as described above, the conventional tractor cannot follow the width variations of continuous paper 6 and, as further shown in FIG. 11, one or more holes 6*a* of continuous paper 6 shift away from one or more pins 4*a*, which will result in poor paper conveying.

Accordingly, it is desired to provide an improved tractor having a construction which will allow continuous paper to be accurately fed even if the width of the continuous paper varies (either increases or decreases) in a tapered manner. It is also desired to provide an improved continuous paper feed mechanism having a construction which uses such an improved tractor construction.

SUMMARY OF THE INVENTION

Generally speaking, in accordance with the present invention, a tractor for feeding continuous sheets of paper with holes in the sides thereof includes at least one frame, a drive pulley and a pin belt, the pin belt being arranged so that it can incline with respect to a paper conveying direction. The tractor further includes a cover plate which has an opening formed to face said continuous paper delivery surface so that a plurality of pins, formed on the pin belt, can extend therethrough. The opening in the cover plate increases in width from a first end of the opening to a second end of the opening. The tractor can also include at least one guide surface for guiding the pin belt, the at least one guide surface increasing in width from a first end of said at least one guide surface to a second end of said at least one guide surface.

In a third embodiment, the tractor actually can pivot about a predetermined axis so that the tractor can more accurately convey the continuous paper in a paper conveying direction.

Lastly, a continuous paper feed mechanism is provided for feeding continuous sheets of paper with holes in the sides thereof. The continuous paper feed mechanism includes a first frame and a second frame positioned a predetermined distance from the first frame, a drive shaft and a guide member each being disposed between said first frame and said second frame, and a first tractor and a second tractor, at least one of the first and second tractors having a pin belt arranged so that the pin belt can incline with respect to a paper conveying direction.

Accordingly, it is an object of the present invention to provide an improved tractor for use in a printing device.

It is another object of the present invention to provide an improve tractor that can convey paper more easily and accurately even though the width of the paper may vary due to change in climate conditions.

Still further, it is an object of the present invention to provide an improved continuous sheet feed mechanism that has a simple construction.

Yet further, it is an object of the present invention to provide an improved successive sheet feed mechanism that can convey paper more easily even though the width of the paper may vary due to change in climate conditions.

Still other objects and advantages of the invention will in part be obvious and will in part be apparent from the specification and drawings.

The invention accordingly comprises the several steps and the relation of one or more of such steps with respect to each of the others, and the article possessing the features, properties and the relation of elements, which are exemplified in the following detailed disclosure, and the scope of the invention will be indicated in the claims.

BRIEF DESCRIPTION OF THE DRAWINGS

For a fuller understanding of the invention, reference is had to the following description taken in connection with the accompanying drawings, in which:

FIG. 2(*b*) is a cross-sectional view of the structure of the tractor taken along line 2*b*—2*b* in FIG. 2(*a*);

FIG. 7(*b*) is a cross-sectional view of the structure of the tractor taken along the line 7*b*—7*b* in FIG. 7(*a*);

FIG. 10(*b*) is a rear view of a conventional printer illustrating the standard operation in which the continuous paper is generally used.

DETAILED DESCRIPTION OF THE PREFERRED EMBODIMENTS

Figure 1:
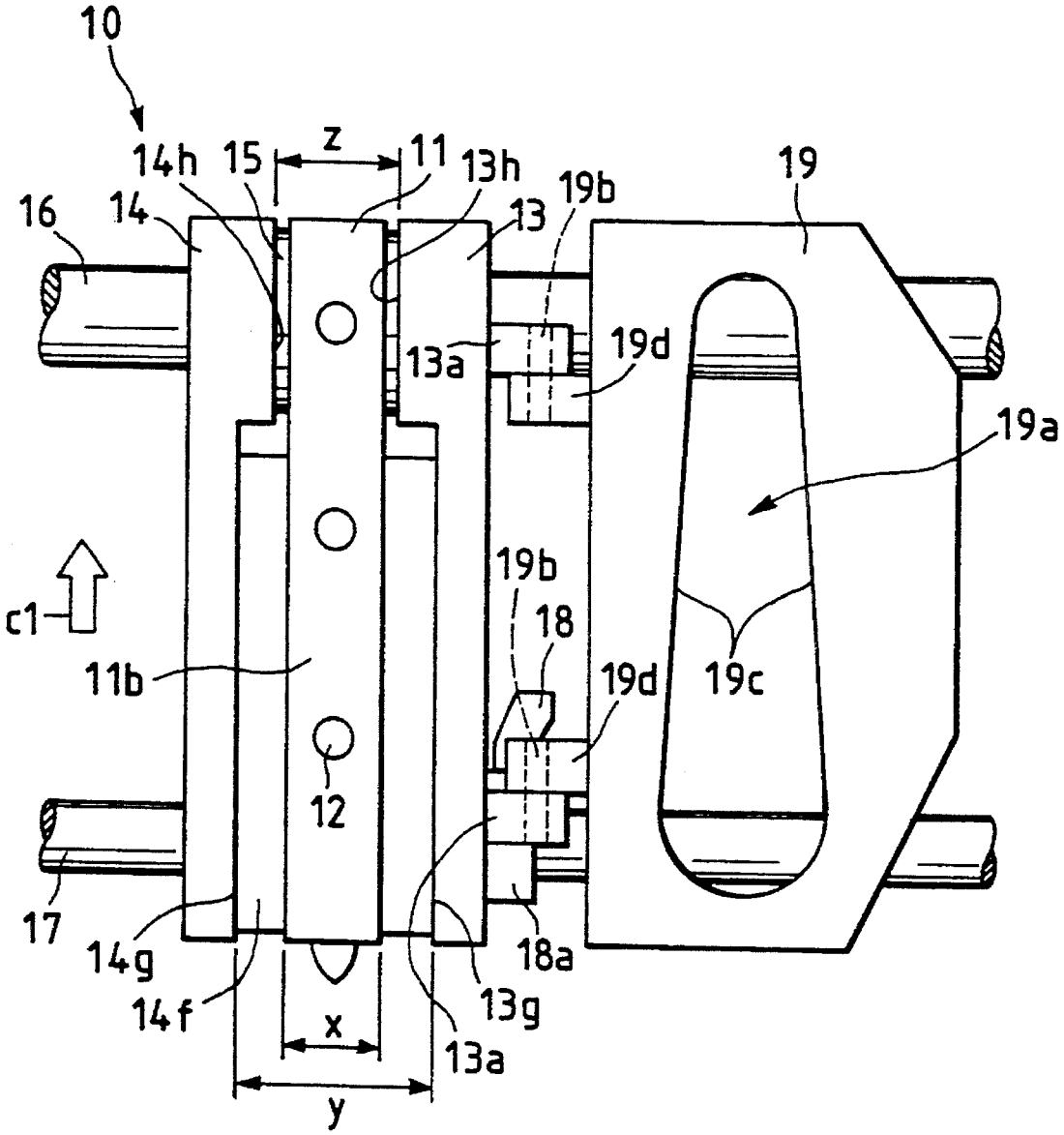
FIG. 1 is a plan view of a tractor in accordance with a first embodiment of the present invention.
Figure 2A:
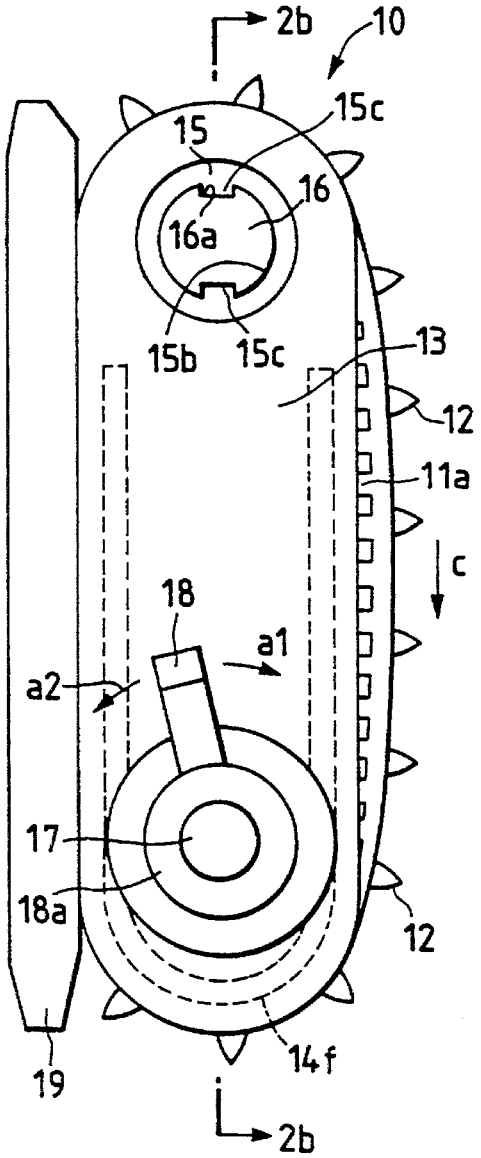
FIG. 2(*a*) is a side view of the tractor in accordance with the first embodiment of the present invention.
Figure 2B:
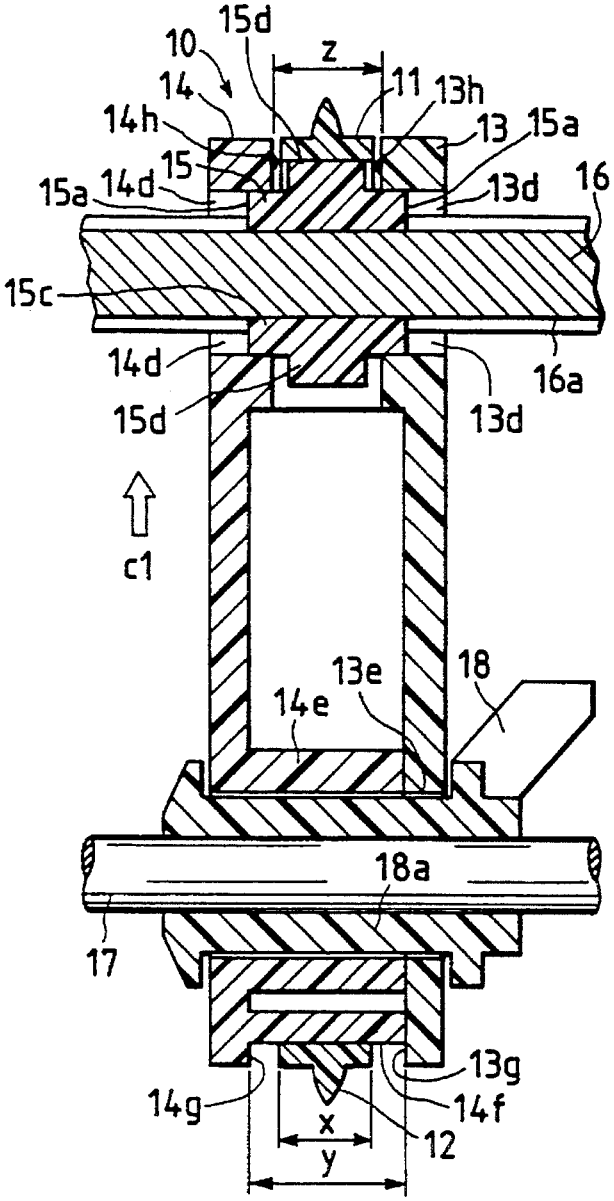

Reference is first made to FIGS. 1, and 2(*a*) and 2(*b*) of the drawings which depict a tractor, generally indicated at 10, constructed in accordance with a first embodiment of the present invention.

Tractor 10 includes an endless type pin belt 11, a main frame 13, a sub-frame 14, a drive pulley 15, a lock lever 18, and a cover plate 19 shown in the open position. Main frame 13 and sub-frame 14 are fixedly connected to each other by connecting means (not shown) such as a bonding agent or the like, and main frame 13 and sub-frame 14 are slidably mounted as a unit on drive shaft 16 and guide shaft 17. It is to be noted that although reference will be made to tractor 10, a second tractor must also be employed for the continuous sheet feed mechanism to properly operate, although the second tractor need not be identical to tractor 10, as will be discussed below with reference to FIG. 8. Further, drive shaft 16 and guide shaft 17 are both supported by a pair of spaced side frames (not shown), as will also be described below with reference to FIG. 8.

As further disclosed in FIG. 2(*b*), main frame 13 includes hole 13*d* and sub-frame 14 includes hole 14*d*. Drive shaft 16 is inserted through holes 13*d* and 14*d*. Drive pulley 15 is rotatably mounted between main frame 13 and sub-frame 14 and is provided with hubs 15*a* on each side which extend into holes 13*d* and 14*d*.

Drive pulley 15 is formed with a central bore 15*b* therethrough for receipt of drive shaft 16 and is constructed and arranged to slide relative to drive shaft 16. Drive pulley 15 is formed with a pair of inwardly projecting tabs 15*c* which are received in longitudinally extending grooves 16*a* in drive shaft 16, so that drive pulley 15 is rotationally driven by drive shaft 16.

Main frame 13 and sub-frame 14 are respectively formed with a hole 13*e* and a mating tubular portion 14*e*, through which guide shaft 17 can be inserted. A tubular member 18*a*, integrally formed with a lock lever 18, is fitted into hole 13*e* and tubular portion 14*e*, and guide shaft 17 is inserted through tubular member 18*a*. Tubular member 18*a* is formed eccentrically. In this configuration, if lock lever 18 is rotated clockwise, as illustrated by arrow al in FIG. 2(*a*), then lock lever 18 engages main frame 13, sub-frame 14 and guide shaft 17 to lock tractor 10 onto guide shaft 17. Likewise, if lock lever 18 is rotated counterclockwise, as illustrated-by arrow a2, then lock lever 18 releases the engagement between tractor 10 and guide shaft 17 to allow tractor 10 to slide relative to guide shaft 17.

One end of the continuous pin belt 11 extends around a central region formed with spaced, outwardly projecting teeth 15*d* for mating with teeth on pin belt 11, and the portion of the pin belt coupled to the continuous paper is preferably rotationally driven in the direction of arrow c in FIG. 2(*a*). A semi-tubular guide portion 14*f* is formed in sub-frame 14 to guide the other end of continuous pin belt 11. Alternatively, a driven pulley can be provided instead of the above-mentioned semi-tubular guide portion 14*e* for guiding the other end of pin belt 11.

Pin belt 11 has an outer surface with an array of substantially conical (i.e., bullet-shaped) pins 12 thereon. In this way, the holes formed in the continuous paper can engage with pins 12 so the continuous paper can be conveyed in paper conveying direction c1 in FIGS. 1 and 2*b*. On the inner surface of pin belt 11 are teeth 11*a* which can engage teeth 15*d* of drive pulley 15.

As illustrated in FIG. 1, the lateral range of displacement of pin belt 11 is restricted in a direction perpendicular to the paper conveying direction arrow cl as it rotates. On the one hand, pin belt 11 is restricted by the contact with inner surface 13*g* on main frame 13 and inner surface 14*g* provided on sub-frame 14. On the other hand, as pin belt 11 revolves around drive pulley 15, it is restricted by the contact with inner surface 13*h* on main frame 13 and inner surface 14*h* on sub-frame 14.

Accordingly, a relationship can be established between pin belt 11, main frame 13 and sub-frame 14. As shown in FIGS. 1 and 2, "x" is the width of pin belt 11, "y" is the distance between inner surface 13*g* on main frame 13 and inner surface 14*g* of sub-frame 14, and "z" is the distance between inner surface 13*h* of main frame 13 and inner surface 14*h* of sub-frame 14. It is clear that pin belt 11 can slide laterally a distance (y–x) around guide portion 14f and a distance (z–x) around drive pulley 15. It is to be noted that y–x is greater than z–x. Therefore, pin belt 11 can incline with respect to the paper conveying direction of the continuous paper. This incline is facilitated by a sufficient slack in the mounting of pin belt 11.

As further shown in FIG. 1, cover plate 19 is constructed and mounted to main frame 13 so that it can open and close. Specifically, main frame. 13 is formed with a pair of hinge portions 13*a* and cover 19 is formed with a pair of corresponding hinge portions 19*d*. Each hinge portion 13*c* is joined to a hinge portion 13*a* by means of a shaft 19*b*. FIG. 1 shows cover plate 19 in the open position. Cover plate 19 has an opening 19*a* to allow pins 12 of pin belt 11 to extend therethrough. Opening 19*a* has a shape in which the two side edges 19*c*, 19*c* thereof are tapered. This corresponds to the inclined range of movement of pin belt 11.

Figure 3:
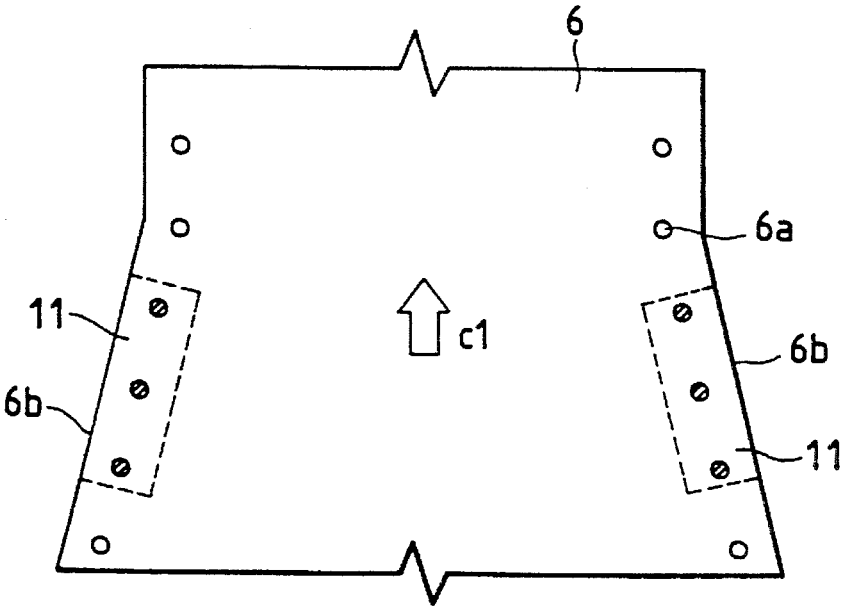
FIG. 3 is a plan view of a sheet of continuous paper which is conveyed in a paper conveying direction showing how the width thereof can vary.

The setting of continuous paper into the tractor as well as the operation of the tractor will now be described with reference to FIGS. 1 to 3.

Continuous paper 6 is first set so that holes 6*a* of continuous paper 6 (FIG. 3) can engage pins 12 of pin belt 11 (FIG. 1). Next, cover plate 19 is closed in order to prevent holes 6*a* from disengaging with pins 12. If necessary, tractor 10 can be adjusted by releasing lock lever 18 from its locking position, setting tractor 10, and thereafter locking lock lever 18.

Once cover plate 19 is closed and tractor 10 is properly adjusted, pin belt 11 is ready for operation. A motor (not shown) or the like drives drive shaft 16. Drive shaft 16 engages drive pulley 15. Pin belt 11 is then rotationally driven by drive pulley 15. Hence, continuous paper 6 is fed in a forward paper conveying direction. (See arrow cl of FIGS. 1, 2 and 3.) Likewise, if the motor rotates drive shaft 16 in the opposite direction, then continuous paper 6 is fed in a reverse paper conveying direction.

Figure 4:
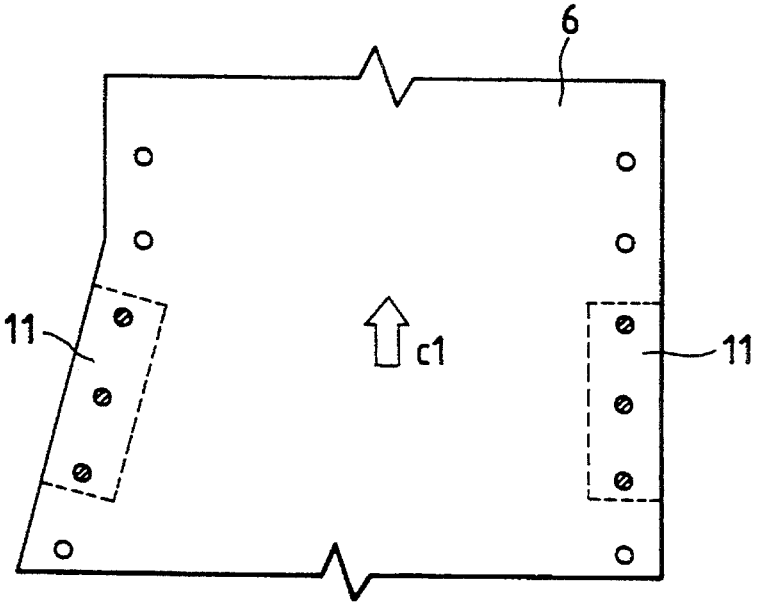
FIG. 4 is a plan view of a sheet of continuous paper which is conveyed in a paper conveying direction showing an alternate way in which the width thereof can vary.

Each of the pins on pin belt 11 is substantially conical. Accordingly, when the pin belt shifts due to the change in width of the paper, there is no problem because round holes 6*a* of the paper will almost always properly align with pins 11. Accordingly, the shape of the pins or holes is not a factor. What is important, as illustrated in FIG. 3, is that if the width of continuous paper 6 increases or decreases, the tapered portion 6*b* of continuous paper 6 reaches pins 12 of pin belt 11 and a transverse force is applied to pins 12 so that pins 12 can continually engage holes 6*a* of continuous paper 6. Accordingly, pin belt 11 can incline and follow the tapered portion of continuous paper 6. By way of example, FIG. 3 illustrates how the width of continuous paper 6 gradually increases. Likewise, the width of continuous paper 6 can gradually decrease (not shown). As further shown in FIG. 4, temperature and/or humidity conditions may cause only one side of the continuous paper 6 to vary in width. However, if the tractors disclosed in the present invention are used, gradual increases or decreases in paper width can be accommodated and accepted. This also results in reducing the amount of paper that might otherwise have to be discarded.

In accordance with the first embodiment, pin belt 11 is constructed and arranged to be freely inclinable with respect to the paper conveying direction of continuous paper 6. Therefore, if the width of continuous paper 6 increases or decreases, pin belt 11 can follow gradual increases or decreases in paper width in continuous paper 6 by rotating accordingly. The possibility that holes 6*a* of continuous paper 6 will shift from pins 12 of pin belt 11 is greatly reduced, resulting in more reliable paper conveying.

Further, since the two side edges 19*c*, 19*c* of opening 19*a* of cover plate 19 are tapered, the inclining operation of pin belt 11 disclosed above is not hindered at all, and continuous paper 6 can be conveyed in a forward or reverse paper conveying direction between a continuous paper delivery surface 11*b* (see FIG. 1) of pin belt 11 and cover plate 19, which also makes it possible to more accurately and reliably convey the continuous paper. Stated another way, if the two side edges 19*c*, 19*c* of opening 19*a* did not taper but rather were parallel to each other equal to the distance at the widest point when tapered, then the distance between the two side edges 19*c* and 19*c* in the region proximate to drive pulley 15 would be wider than necessary and would prevent cover plate 19 from properly holding continuous paper 6. Accordingly, the possibility that cover plate 19 will not properly secure continuous paper 6 is essentially eliminated since the two side edges 19*c* and 19*c* of the opening 19*a* are in fact tapered.

Figure 9:
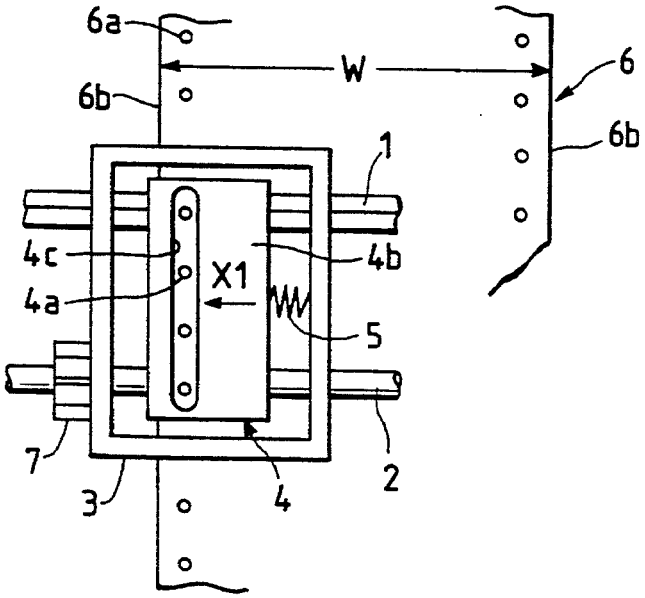
FIG. 9 PRIOR ART
FIG. 9 is a plan view of a conventional tractor in accordance with the prior art.

A tractor constructed and arranged in accordance with this first embodiment eliminates the critical positioning of the corrugated cardboard box. However, this problem is first discussed with reference to the conventional tractor and printer in FIGS. 9, 10 & 11.

Figure 10A:
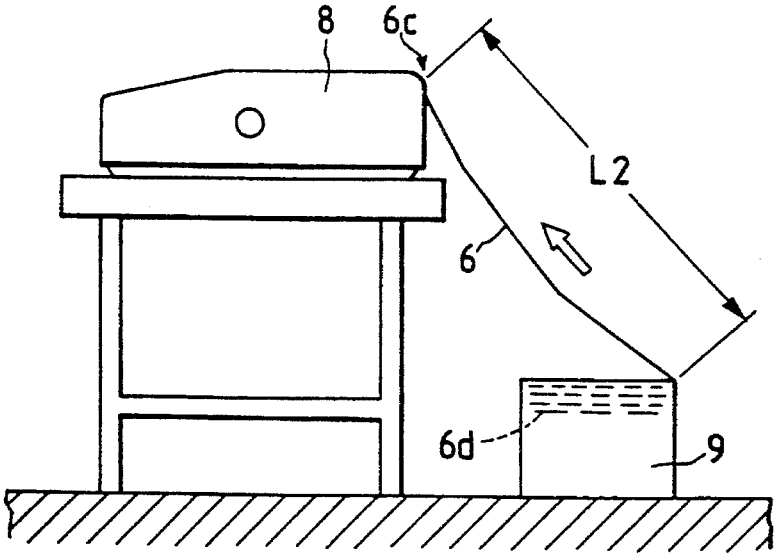
FIG. 10(a) PRIOR ART
FIG. 10(*a*) is a side view of a conventional printer illustrating the standard operation in which the continuous paper is generally used.
Figure 10B:
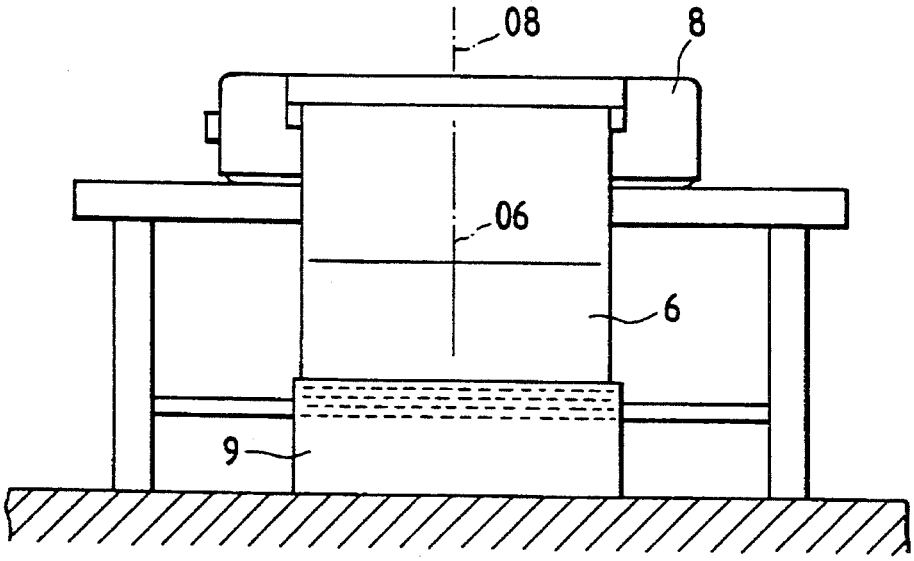
FIG. 10(b) PRIOR ART
Figure 11:
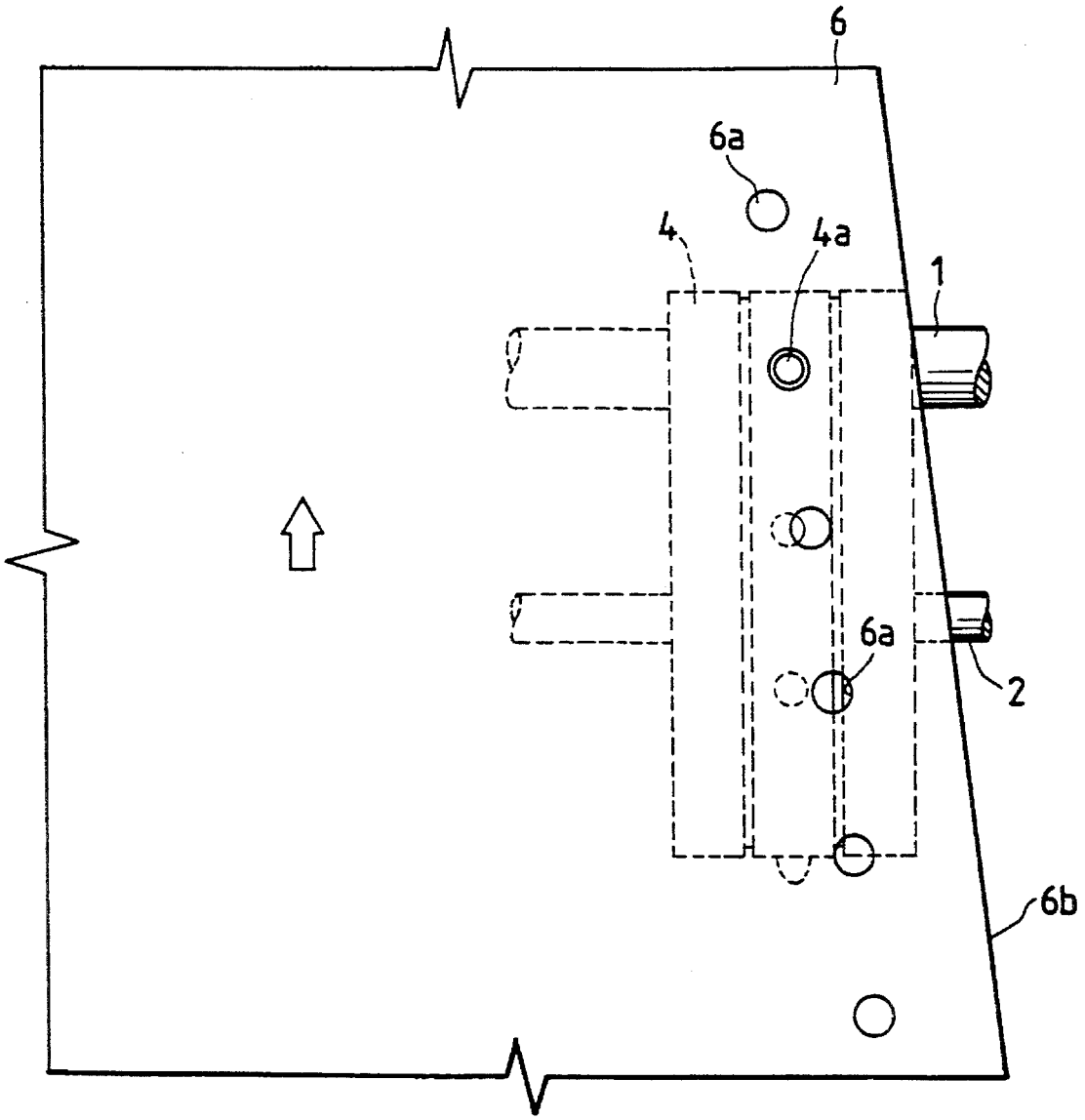
FIG. 11 PRIOR ART
FIG. 11 is a plan view of a conventional tractor during a paper feed operation in accordance with the prior art.

Referring to the conventional printer in FIG. 10(*a*), when front end 6*c* of the continuous paper is set in the tractor of conventional printing apparatus 8, unused portion 6*d* of the continuous paper remains stored in corrugated cardboard box 9 which is placed on the floor or the like. However, as shown in FIG. 10(*b*), corrugated cardboard box 9 must be set so that a center line 08 (accurately, a line passing between a pair of tractors) of printing apparatus 8 is substantially coincident with a center line 06 of continuous paper 6. If center lines 08 and 06 are not aligned with each other, then continuous paper 6 will be set at an angle relative to the tractor and thus there will be poor alignment between the holes of the continuous paper and the pins, resulting in poor paper conveying.

More specifically, if the distance between center lines 08 and 06 is defined as $\delta 1$, the difference between the diameter of a pin on the pin belt and the diameter of a hole in the paper is defined as d, and the amount that hole 6*a* can deform is $\lambda$, then to ensure proper paper conveying, the relationship $\delta 1 < d+\lambda$ must be satisfied. Because d and $\lambda$ are small, it is apparent that it is very difficult to satisfy the above relationship while aligning the corrugated cardboard box and the paper.

However, as will now be described, using the tractor of the present invention eliminates such need for precision. Since pin belt 11 of tractor 10 is constructed and arranged to incline freely, it is not necessary to set the corrugated cardboard box 9 as severely as in the conventional tractor.

Figure 5:
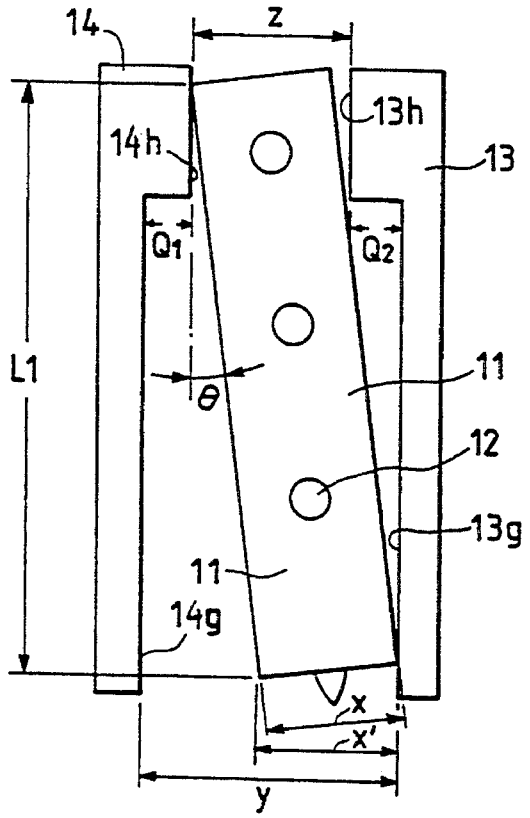
FIG. 5 is a plan view showing how the pin belt can pivot so as to be inclined to the normal paper feed direction during the operation of the tractor constructed in accordance with the first embodiment of the invention.

Referring to FIG. 5, the following relationships are established as:

(1) The maximum angle of inclination from the neutral position of pin belt 11 is expressed as $\theta$;

(2) the length of pin belt 11 (precisely, the length of pin belt 11$\times\cos\theta$) is expressed as L1; and (3) $x'=x/\cos\theta$.

Because $x'-x$ is very small compared to L1, $\tan\theta$ can be expressed:

$$\tan\theta=[((y+z)/2)-x]/L1.$$

Therefore, as shown in FIG. 10(*a*), when the length of the continuous paper from the tractor to the corrugated cardboard box 9 is expressed as L2, then the amount $\delta 2$ of the allowable shift in the transverse direction between the center lines 08 and 06 in the present embodiment can be obtained from the following equation:

$$\delta 2=L2\times\tan\theta+d+\lambda.$$

Since L2 is very large with respect to L1, the amount of the allowable shift $\delta 2$ in the present embodiment is considerably larger than the amount of the allowable shift $\delta 1$ in the conventional tractor.

Therefore, by using tractor 10 of the present embodiment instead of a conventional tractor, there is very little criticality in the placement of the corrugated cardboard box 9 and ultimately the paper alignment.

Figure 6:
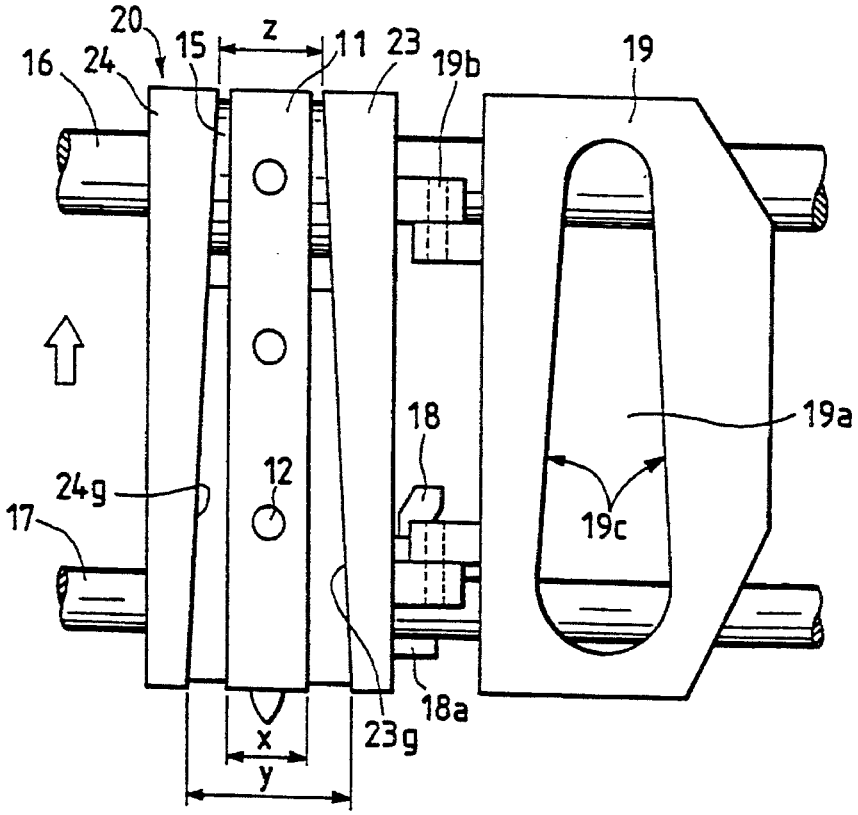
FIG. 6 is a plan view of a tractor in accordance with a second embodiment of the present invention.

Reference is now made to FIG. 6, disclosing a tractor, shown generally at 20, in accordance with a second embodiment of the invention.

Tractor 20, in accordance with the second embodiment, shows an alternate construction and arrangement of a main frame 23 and a sub-frame 24, and the remaining portions thereof are essentially similar in structure to those in the previously described first embodiment. Therefore, in FIG. 6, the parts of the second embodiment similar in structure to those in the first embodiment are respectively given the same reference numerals and the description thereof is omitted here.

Main frame 23 and sub-frame 24 of tractor 20 include inner surfaces 23*g* and 24*g*, respectively. Inner surfaces 23*g* and 24*g* are tapered guide surfaces slidingly contactable with the side surfaces of the pin belt 11. Furthermore, inner surfaces 23*g* and 24*g* are inclined to the maximum angle which pin belt 11 can incline to assist in the guiding of pin belt 11.

Tractor 20 operates similarly and has the same advantages as tractor 10 in the first embodiment. In addition, because guide surfaces 23*g* and 24*g* are tapered, the inclined pin belt 11 is guided by guide surfaces 23*g* and 24*g* so that the continuous paper can be conveyed both accurately and reliably.

Figure 7A:
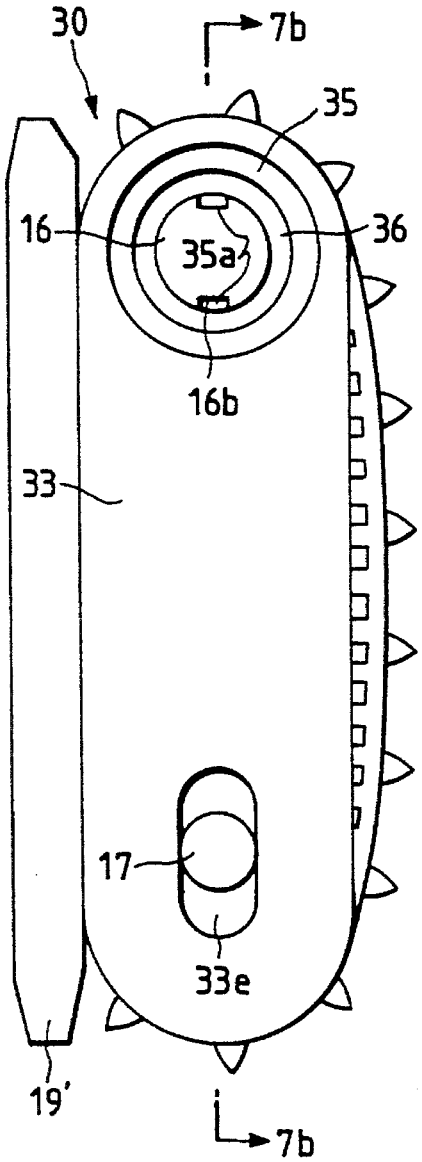
FIG. 7(*a*) is a side view of the tractor in accordance with a third embodiment of the present invention.
Figure 7B:
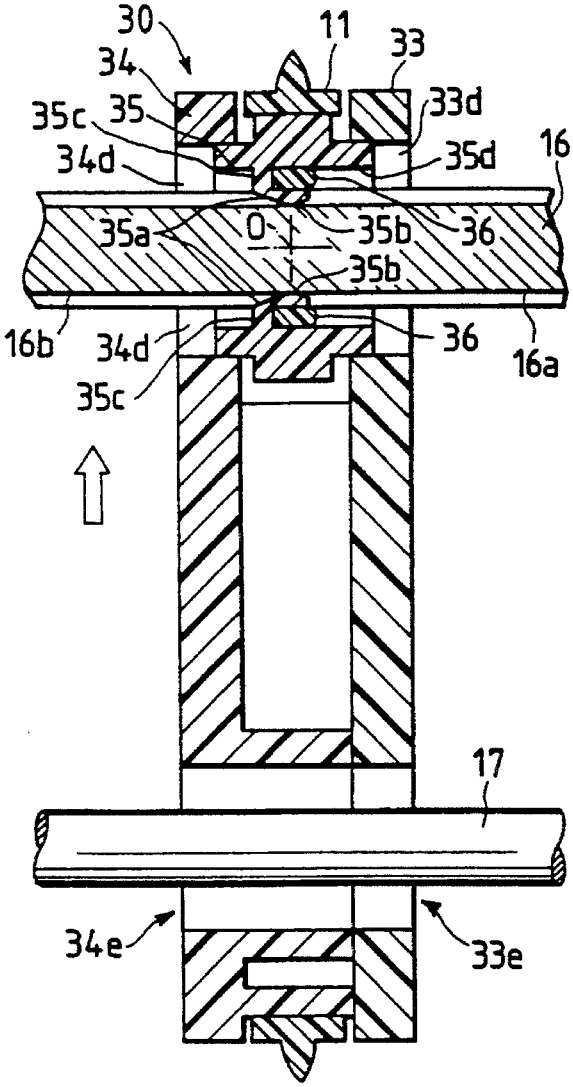

Reference is now made to FIG. 7, disclosing a tractor, shown generally at 30, in accordance with a third embodiment of the invention. In this third embodiment, the entire tractor 30 can incline. Like reference numerals are used for like elements in prior embodiments.

Tractor 30 includes a pin belt 11, a main frame 33, a sub-frame 34, a drive pulley 35, and a cover plate 19'. Because tractor 30 can incline, the cover plate can be formed of a similar construction to the conventional cover plate (with an elongated slot having parallel rather than tapered sides).

Drive pulley 35, similar to drive pulley 15 (FIG. 2), is formed with laterally extending hubs respectively extending into a hole 33*d* in main frame 33 and a hole 34*d* in sub-frame 34. Like drive pulley 15, drive pulley 35 can also rotate. The center O of drive pulley 35 forms the axis upon which it rotates/inclines.

Formed in an inner surface 35*d* of drive pulley 35, there is a pair of hold portions 35*a* integrally formed therewith. Like tabs 15*c* of drive pulley 15, hold portions 35*a* are constructed and arranged to engage in a recessed groove 16*a* formed in drive shaft 16, and to hold drive shaft 16 elastically.

Hold portions 35*a* each include a projection-like pressure portion 35*b* for exerting pressure against the bottom surface 16*b* of the respective recessed groove 16*a* of drive shaft 16. Pressure portions 35*b* have arcuate inner surfaces to define line contact with bottom surface 16*b* of the associated groove 16*a*. Hold portions 35*a* also include a connecting portion 35*c* for interconnecting pressure portion 35*b* with inner surface 35*d* of drive pulley 35 integrally and elastically. Connecting portions 35*c* are elastic and permit each pressure portion 35*b* to rotate about its associated connecting portion 35*c*.

An annular elastic member 36, typically an O-ring, is inserted between pressure portion 35*b* and inner surface 35*d* of drive pulley 35 and is supported by drive pulley 35. Annular elastic member 36 has an inner diameter smaller than the outer diameter of drive shaft 16. Annular elastic member 36 strengthens the holding force of drive shaft 16 by applying pressure to pressure portions 35*b*, 35*b*. Annular elastic member 36 acts to resist against unintended sliding of tractor 30 relative to drive shaft 16 and guide shaft 17.

Tractor 30, in accordance with the third embodiment, can pivot about an intermediate point O between the two pressure portions 35*b*, 35*b* which results in pin belt 11 being permitted to freely incline with respect to the paper conveying direction of continuous paper 6.

To permit the pivotable movement of tractor 30, a pair of elongated insertion holes 33*e* and 34*e* are respectively formed in main frame 33 and sub-frame 34, with guide shaft 17 passing therethrough.

When it is desired to laterally displace tractor 30 along drive shaft 16 and guide shaft 17, a force sufficient to overcome the frictional force of pressure portions 35*b* can be normally applied to tractor 30 to permit tractor 30 to be displaced along the width direction of the continuous paper.

Tractor 30, constructed and arranged in accordance with the third embodiment, operates essentially the same as the tractor in the first two embodiments, and likewise, has the same advantages.

In addition, the structure of tractor 30 can be simplified because lock lever 18, present in tractor 10, can be eliminated.

Figure 8:
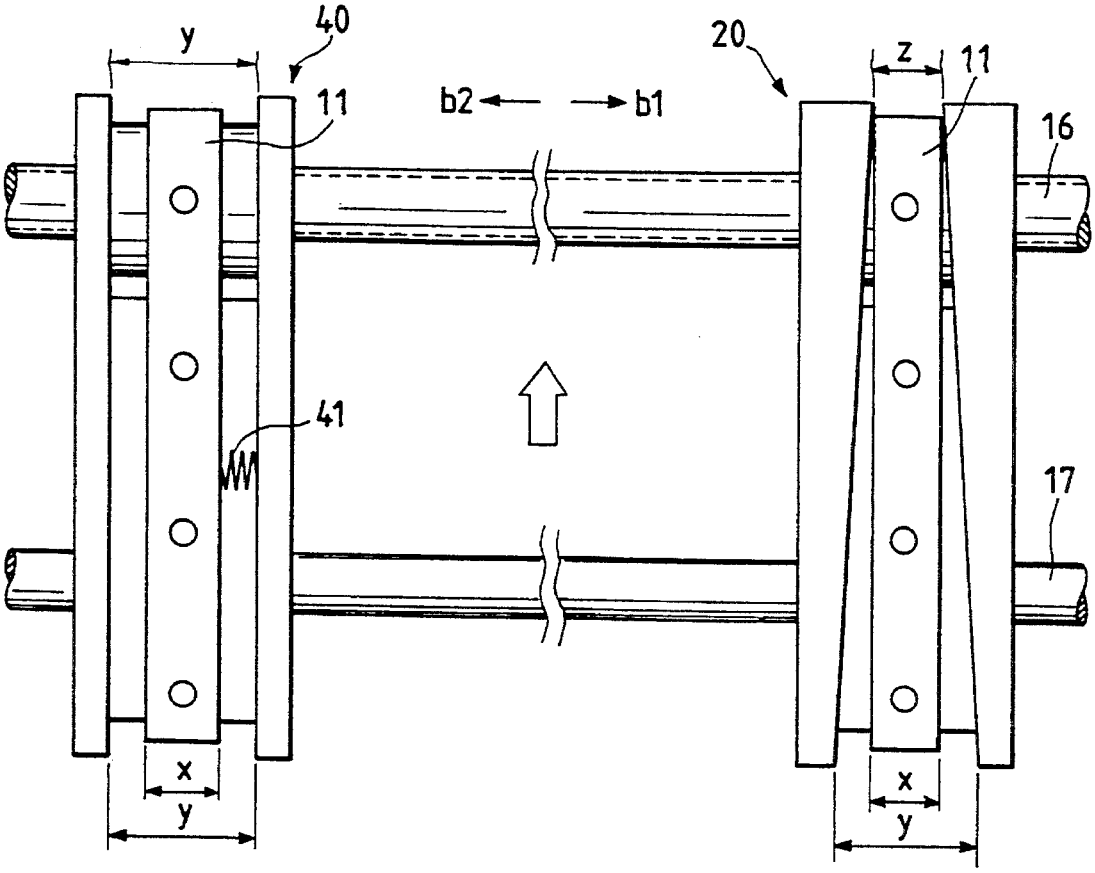
FIG. 8 is a plan view of a continuous paper feed mechanism in accordance with the invention.

Reference is now made to FIG. 8 in which a continuous paper feed mechanism utilizing a tractor in accordance with the above embodiments is disclosed.

A continuous sheet feed mechanism has a first frame (not shown) positioned a predetermined distance from a second frame (not shown). The first frame and second frame are formed from the side frames of a printer or a similar device. Extending between the first frame and the second frame is drive shaft 16 and guide shaft 17. Tractor 20 and 40 are mounted on drive shaft 16 and guide shaft 17.

As shown in FIG. 8, two tractors are provided. In this embodiment, a tractor 20 as disclosed in the second embodiment is positioned on the right as viewed in FIG. 8, and tractor 40 constructed in accordance with the prior art is positioned on the left. Tractor 40 is arranged to permit a pin belt 11 to be slidably mounted in the direction of arrows b1, b2 against the force of a spring 41. The print head of the printing apparatus (not shown) may be designed and arranged so that printing takes place either from right to left or left to right as shown in FIG. 8.

Accordingly, when the continuous paper increases or decreases in the widthwise direction and the two side edge portions 6*b*, 6*b* of continuous paper 6 remain parallel to each other, the increase or decrease of the paper width is absorbed by the sliding action of pin belt 11 of tractor 40. However, when the width of the continuous paper increases or decreases such that the two side edge portions 6*b* and 6*b* are now tapered, the width variations are absorbed by the inclining operation of pin belt 11 of tractor 20. That is, in either of the examples above, or when the above-mentioned two kinds of width variations or deformations occur essentially simultaneously, the continuous paper can be properly conveyed in either a forward or reverse paper-conveying direction.

It should be noted here that similar operation and effects can be obtained when a tractor disclosed in the first or third embodiment is used instead of tractor 20 in accordance with the second embodiment.

Furthermore, other modifications or changes can be made to the above-mentioned embodiments. For example, pin belt 11 is constructed so that the upstream side thereof in the direction of the continuous paper feed can pivot about downstream side thereof. However, just as effectively and with the same results, pin belt 11 can be constructed so that the downstream side thereof in the direction of the continuous papter feed can pivot about upstream side thereof.

Therefore, the tractor of the present invention and the continuous sheet feed mechanism employing the tractor of the present invention results in a more accurate and more reliable operation for conveying paper, and further, a positive continuous sheet feed operation can be executed. Specifically, if the width of the continuous paper varies due to a change in temperature or humidity, using the tractor and continuous sheet feed mechanism of the present invention will yield more reliable and accurate paper conveying in a printer.

It will thus be seen that the objects set forth above, among those made apparent from the preceding description, are efficiently attained and, since certain changes may be made in carrying out the above method without departing from the spirit and scope of the invention, it is intended that all matter contained in the above description shall be interpreted as illustrative and not in a limiting sense.

It is also to be understood that the following claims are intended to cover all of the generic and specific features of the invention herein described, and all statements of the scope of the invention which, as a matter of language, might be said to fall therebetween.

What is claimed is:

1. A tractor for feeding continuous paper with holes in the sides thereof in a paper conveying direction, comprising:

at least one frame;

a drive pulley supported by said frame;

a pin belt coupled to said drive pulley for advancement thereby and formed with pins for engaging in the holes of the continuous paper; and means for permitting said pin belt to incline in the lateral direction of said paper for the purpose of compensating for taper in said paper due to climate variation.

2. The tractor as claimed in claim 1, wherein said pin belt is formed with a continuous paper delivery surface, said tractor including a cover plate having an opening formed to face said continuous paper delivery surface so that a plurality of pins, formed on the pin belt, can extend therethrough, said opening in said cover plate is formed with a pair of spaced side edges defining a tapered opening.

3. The tractor as claimed in claim 2, wherein said opening in said cover plate decrease in width in the paper side conveying direction.

4. The tractor as claimed in claim 3, wherein said pin belt is formed with side surfaces, said means for permitting said pin belt to incline including at least one guide surface supported by said frame for slidable engagement by a side surface of said pin belt for guiding and defining a limit of inclination of said pin belt, said at least one guide surface defining an angle to the paper conveying direction.

5. The tractor as claimed in claim 4, wherein said means for permitting said pin belt to incline includes a spaced pair of said inclined guide surfaces supported by said frame and defining a space between them tapered in the paper conveying direction to limit inclination of the pin belt.

6. The tractor as claimed in claim 5, wherein each of said inclined guide surfaces is discontinuous and includes first portions in the region of one end of the tractor as viewed in the paper conveying direction and second portions in the region of the other end of the tractor, said second portions being spaced farther from each other than said first portions are spaced from each other.

7. The tractor as claimed in claim 1, wherein said pin belt is formed with side surfaces, said means for permitting said pin belt to incline including at least one inclined guide surface supported by said frame for slidable engagement by a side surface of said pin belt for guiding and defining a limit of inclination of said pin belt, said at least one inclined guide surface defining an angle to the paper conveying direction.

8. The tractor as claimed in claim 7, wherein said means for permitting said pin belt to incline includes a spaced pair of said inclined guide surfaces supported by said frame and defining a space between them tapered in the paper conveying direction to limit inclination of the pin belt.

9. The tractor as claimed in claim 8, wherein each of said inclined guide surfaces is discontinuous and includes first portions in the region of one end of the tractor as viewed in the paper conveying direction and second portions in the region of the other end of the tractor, said second portions being spaced farther from each other than said first portions are spaced from each other.

10. The tractor as claimed in claim 1 for mounting on at least a drive shaft, said means for permitting said pin belt to incline including means for coupling said drive pulley to said drive shaft so that said pin belt is advanced by said drive shaft and drive pulley, said coupling means further permitting said tractor to pivot relative to said drive shaft so as to permit said pin belt to incline relative to said paper conveying direction.

11. A tractor for mounting on a drive shaft extending laterally of a paper conveying direction for feeding continuous paper with holes in the sides thereof in the paper conveying direction, comprising:

at least one frame;

a drive pulley rotatably mounted on said frame;

a pin belt coupled to said drive pulley for being driven thereby; and means for coupling said drive pulley to said drive shaft for rotation of said drive pulley by said drive shaft to drive said pin belt and for permitting the pivoting of said drive pulley and frame relative to said drive shaft so that said pin belt can incline in the lateral direction of said paper for the purpose of compensating for taper in said paper due to climate variation.

12. The tractor as claimed in claim 11, wherein said pin belt has a continuous paper delivery surface supporting a plurality of pins and said tractor includes a cover plate having an opening formed to face said continuous paper delivery surface so that said plurality of pins formed on said pin belt can extend therethrough.

13. The tractor as claimed in claim 11, wherein said drive shaft is formed with at least one longitudinally extending recessed groove having a bottom surface, said drive pulley being formed with a wall defining an aperture therethrough through which said drive shaft extends, said coupling means including a hold portion formed on said wall of said drive pulley defining said aperture and projecting onto each of said recessed grooves for operationally coupling said drive shaft and drive pulley for rotation of said drive pulley, each of said hold portions being formed to engage the bottom surface of the associated groove and to permit pivoting of the tractor at the point of contact between the hold portion and the bottom surface of the groove.

14. The tractor as claimed in claim 13, wherein the hold portion includes a radially extending connecting portion and a laterally extending pressure portion coupled to the outer end of the connecting portion for engagement in the associated groove.

15. The tractor as claimed in claim 14, wherein the surface of the pressure portion engaging the bottom surface of the groove is arcuate.

16. The tractor as claimed in claim 15, wherein said tractor includes a resilient annular member intermediate said pressure portion and said wall of the drive pulley defining said aperture for biasing said pressure portion apart from said drive shaft.

17. The tractor as claimed in claim 13 for being additionally supported by a guide shaft, said frame including an elongated slot through which said guide shaft extends.

18. A continuous paper feed mechanism for feeding continuous sheets of paper with holes in the sides thereof in a paper conveying direction, comprising:

a drive shaft and a guide shaft, each extending laterally of the paper conveying direction in parallel spaced relation;

a first tractor and a second tractor each including a pin belt, at least one of said first and second tractors including means for supporting the associated pin belt relative to the drive shaft so that said associated pin belt can incline in the lateral direction of said paper for the purpose of compensating for taper in said paper due to climate variation.

19. The continuous paper feed mechanism as claimed in claim 18, wherein the other of said first and second tractors includes means for supporting its pin belt relative to the drive shaft so that the pin belt of said other tractor is displaceable in the longitudinal direction of the drive shaft.

* * * * *